US011489294B2

(12) United States Patent
Yoshimura

(10) Patent No.: US 11,489,294 B2
(45) Date of Patent: Nov. 1, 2022

(54) CONNECTION MODULE AND CABLE ASSEMBLY

(71) Applicant: Tyco Electronics Japan G.K., Kawasaki (JP)

(72) Inventor: Kentaro Yoshimura, Kawasaki (JP)

(73) Assignee: Tyco Electronics Japan G. K., Kawaski (JP)

( * ) Notice: Subject to any disclaimer, the term of this patent is extended or adjusted under 35 U.S.C. 154(b) by 0 days.

(21) Appl. No.: 17/161,003

(22) Filed: Jan. 28, 2021

(65) Prior Publication Data

US 2021/0242633 A1 Aug. 5, 2021

(30) Foreign Application Priority Data

Jan. 30, 2020 (JP) ..... JP2020-014001

(51) Int. Cl.

| | |
|---|---|
| ***H01R 13/6592*** | (2011.01) |
| ***H01R 13/502*** | (2006.01) |
| ***H01R 13/639*** | (2006.01) |
| ***H01R 13/6473*** | (2011.01) |

(52) U.S. Cl.

CPC ..... *H01R 13/6592* (2013.01); *H01R 13/502* (2013.01); *H01R 13/639* (2013.01); *H01R 13/6473* (2013.01)

(58) Field of Classification Search

CPC ..... H01R 13/6593; H01R 13/6592; H01R 13/502; H01R 13/639; H01R 13/6473

USPC ..... 439/607.47, 607.56, 607.58

See application file for complete search history.

(56) References Cited

U.S. PATENT DOCUMENTS

| | | | | |
|---|---|---|---|---|
| 10,033,140 | B2 | 7/2018 | Kanda et al. | |
| 10,950,979 | B2 * | 3/2021 | Lodding ..... | H01R 13/6477 |
| 2019/0393651 | A1 | 12/2019 | Lodding et al. | |

FOREIGN PATENT DOCUMENTS

| | | | |
|---|---|---|---|
| DE | 10 2019 214966 | A1 | 4/2021 |
| EP | 2395606 | A1 | 12/2011 |
| JP | 2017204335 | A | 11/2017 |
| JP | 2018014260 | A | 1/2018 |

OTHER PUBLICATIONS

Abstract of JP2017204335, dated Nov. 16, 2017, 1 page.
Extended European Search Report, dated Jun. 8, 2021,10 pages.
English translation of DE 10 2019 214966A1, dated Apr. 1, 2021, 16 pages.

* cited by examiner

*Primary Examiner* — Gary F Paumen
(74) *Attorney, Agent, or Firm* — Barley Snyder

(57) ABSTRACT

A connection module includes a first assembly and a second assembly. The first assembly has a rest portion for resting thereon an exposed portion of a covered electrical wire for differential signal transmission. A cable accommodates the covered electrical wire in a jacket. The exposed portion is not covered with the jacket, exposing a covering of the covered electrical wire. The second assembly has a presser portion pressing the exposed portion rested on the rest portion against the rest portion. A position of the exposed portion is determined by combining the first assembly with the second assembly.

20 Claims, 6 Drawing Sheets

CONNECTION MODULE AND CABLE ASSEMBLY

CROSS-REFERENCE TO RELATED APPLICATION

This application claims the benefit of the filing date under 35 U.S.C. § 119(a)-(d) of Japanese Patent Application No. 2020-14001, filed on Jan. 30, 2020.

FIELD OF THE INVENTION

The present invention relates to a connection module and, more particularly, to a connection module connected with a cable for relaying a signal transmitted via the cable.

BACKGROUND

A cable can accommodate a covered electrical wire for differential signal transmission in a jacket. To an end portion of this cable, a connection module for connection with another cable, for example, is connected. In order to connect the connection module to the end portion of the cable, an end portion of the jacket of the cable is stripped off to expose the covered electrical wire. Then, a covering at a leading end portion of the exposed covered electrical wire is stripped off to expose a core wire, and a contact is connected to the core wire by crimping, for example.

The end portion of the cable has the covered electrical wire exposed and is therefore in a different environment from the inside of the jacket, so that an impedance mismatch is likely to occur. In order to suppress this impedance mismatch, Japanese Patent Application No. 2017-204335A and Japanese Patent Application No. 2018-014260A suggest connectors having a metal plate for impedance adjustment positioned near an exposed portion where the covered electrical wire is exposed.

In the connectors of Japanese Patent Application No. 2017-204335A and Japanese Patent Application No. 2018-014260, the metal plate for impedance adjustment is arranged in a position separated from the exposed portion where the covered electrical wire is exposed. Therefore, a structure for locating and fixing this exposed portion needs to be constituted separately from the metal plate for impedance adjustment. In addition, in the case of the connectors of Japanese Patent Application No. 2017-204335A and Japanese Patent Application No. 2018-014260, since the metal plate for impedance adjustment is arranged in a position separated from the exposed portion where the covered electrical wire is exposed, an impedance match can be insufficient.

SUMMARY

A connection module includes a first assembly and a second assembly. The first assembly has a rest portion for resting thereon an exposed portion of a covered electrical wire for differential signal transmission. A cable accommodates the covered electrical wire in a jacket. The exposed portion is not covered with the jacket, exposing a covering of the covered electrical wire. The second assembly has a presser portion pressing the exposed portion rested on the rest portion against the rest portion. A position of the exposed portion is determined by combining the first assembly with the second assembly.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
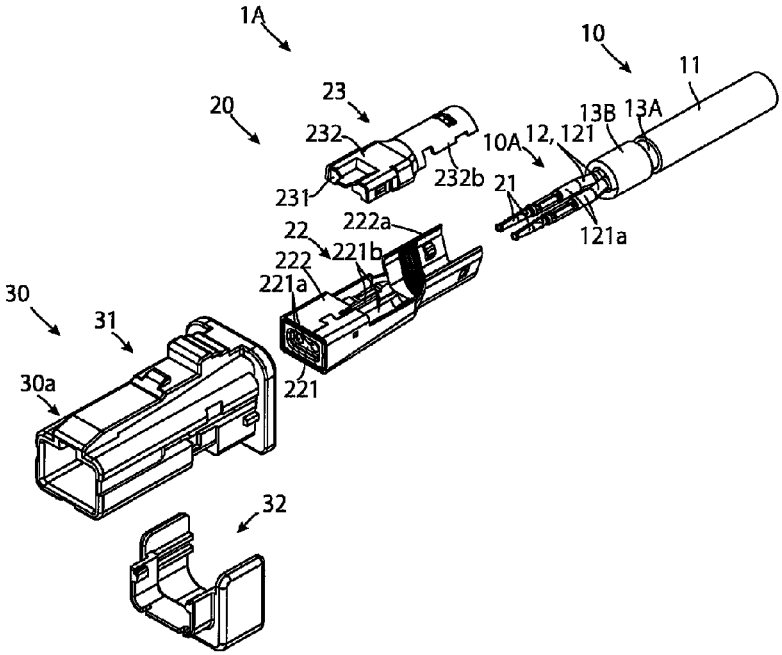
FIG. 1 is an exploded perspective view of a cable assembly according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. Furthermore, several aspects of the embodiments may form—individually or in different combinations—solutions according to the present invention. The following described embodiments thus can be considered either alone or in an arbitrary combination thereof.

FIG. 1 is an exploded isometric view of a cable assembly 1A according to an embodiment. The cable assembly 1A shown in FIG. 1 includes a connection module 20 according to a first embodiment. The cable assembly 1A has a cable 10, a connection module 20, and an outer housing 30. The cable 10 has a tubular jacket 11 and a pair of covered electrical wires 12 for differential signal transmission positioned within the jacket 11. These two covered electrical wires 12 are twisted around each other to form a twisted pair wire. The cable 10 has a shield layer 13, shown in FIG. 4A, formed by braiding thin conductors around the pair of covered electrical wires 12 within the jacket 11 thereof.

Figure 4A:
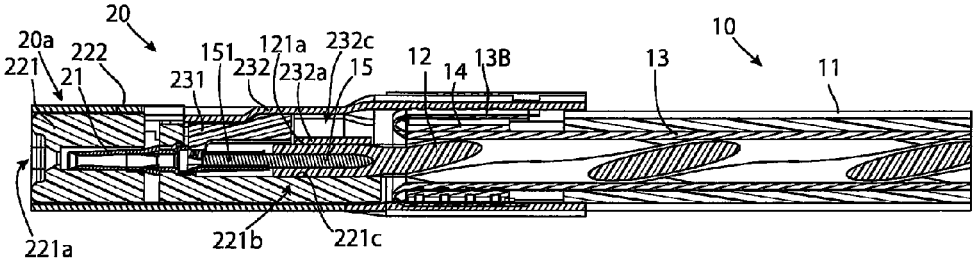
FIG. 4A is a sectional side view of the connection module after assembly completion, taken along arrows X-X of FIGS. 3A and 3B.

A leading end portion 10A of the cable 10, shown in FIG. 1, has a structure processed in the following manner. The leading end portion 10A has the shield layer 13 exposed by removing the jacket 11. Then, a rear portion of an exposed portion of the shield layer 13 is covered with a tubular ferrule 14, as shown in FIG. 4A. The exposed portion is not covered with the jacket 11 and exposes a covering of the covered electrical wires 12. Further, a front portion of the exposed portion of the shield layer 13 is folded back on the ferrule 14. A portion 13A of an exposed non-folded-back portion and a portion 13B folded back on the ferrule 14 of the shield layer 13 can be seen in FIG. 1.

By folding back the shield layer 13 on the ferrule 14, front end portions 121 of the two covered electrical wires 12 are exposed, as shown in FIG. 1. Then, further, a covering at a portion of a front end of the exposed front end portion 121 of the covered electrical wire 12 is stripped off to expose a front end portion 151 of a core wire 15 inside the covered electrical wire 12, shown in FIG. 4A. Then, a contact 21 is fixed by crimping to the front end portion 151 of the exposed core wire 15. The contact 21 is a contact constituting the connection module 20, and is a female contact into which a rod-like mating contact is inserted.

The connection module 20 in the embodiment shown in FIG. 1 has a first assembly 22 and a second assembly 23, in addition to the contact 21 connected by crimping to the core wire 15 of the cable 10.

The first assembly 22 has an insulative inner housing 221 and a metal shell 222 enclosing the inner housing 221. This metal shell 222 circumferentially encloses a front portion of the inner housing 221. In addition, the metal shell 222 encloses a lower portion and both side portions of a rear portion of the inner housing 221, but is opened upward. This metal shell 222 is equivalent to an example of a first metal shell defined in the present invention.

An insertion hole 221*a* into which the contact 21 is inserted is formed in the front portion of the inner housing 221 that is circumferentially enclosed by the metal shell 222, as shown in FIG. 1. In addition, a rest portion 221*b* on which a portion of the exposed front end portion 121 of the covered electrical wire 12 is rested is formed in the upward-opened rear portion of this inner housing 221. Furthermore, the inner housing 221 has a structure in which, when the contact 21 is inserted to a proper position in the insertion hole 221*a* of the inner housing 221, a portion of the front end portion 121 of the covered electrical wire 12 rests on the rest portion 221*b*. A portion of the front end portion 121 of the covered electrical wire 12 that rests on the rest portion 221*b* is referred to here as exposed portion 121*a*. In an embodiment, the rest portion 221*b* is formed integrally with a member constituting the first assembly 22 and has not only an action as the rest portion 221*b* but also another action, and as a portion of the member.

The second assembly 23, as shown in FIG. 1, has an inner housing 231 and a metal shell 232. The inner housing 231 covers from above a portion crimped to the contact 21 of the core wire 15. In addition, a presser portion 232*a*, shown in FIGS. 4A and 4B, for pressing from above the exposed portion 121*a* of the covered electrical wire 12 resting on the rest portion 221*b* of the first assembly 22 is provided in the metal shell 232. The details will be described later. The metal shell 232 of the second assembly 23 is equivalent to an example of a second metal shell defined in the present invention.

The outer housing 30 has an outer housing main body 31 and a retainer 32, as shown in FIG. 1. The connection module 20 in an assembled state composed of the contact 21, the first assembly 22, and the second assembly 23 is accommodated in the outer housing main body 31. Then, the retainer 32 is fitted onto the outer housing main body 31 accommodating the connection module 20. By fitting this retainer 32 thereonto, the connection module 20 is so fixed so to be retained in the outer housing main body 31. The description of the outer housing 30 is finished here, and a cable mounting structure using the connection module 20 will be described in detail below.

Figure 2A:
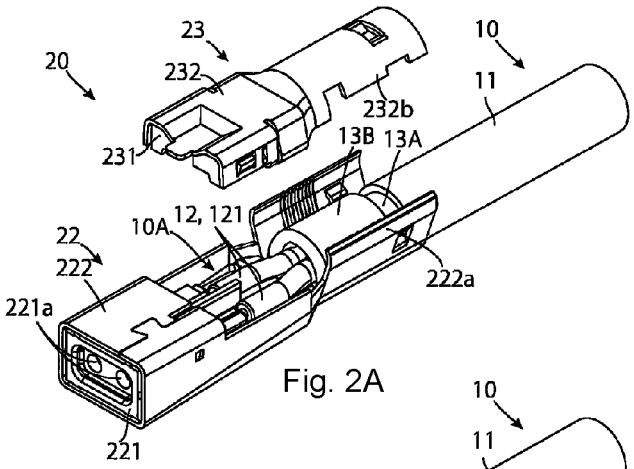
FIG. 2A is a top exploded perspective view of a cable and a connection module of the cable assembly.
Figure 2B:
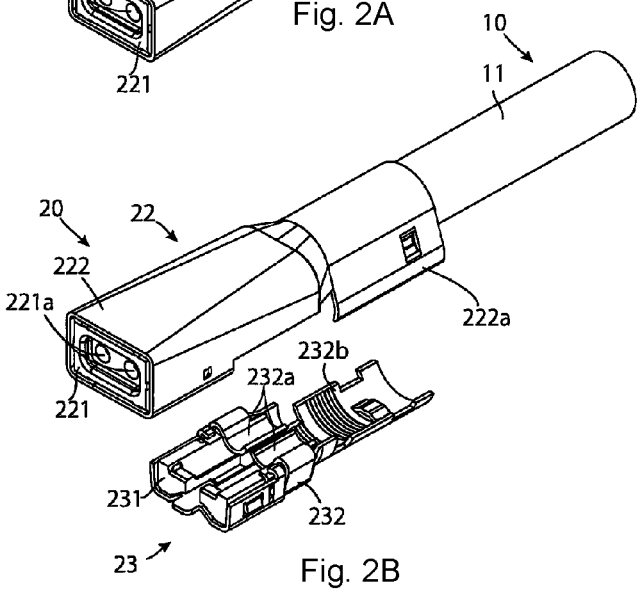
FIG. 2B is a bottom exploded perspective view of the cable and the connection module.

FIGS. 2A and 2B are exploded isometric views of the cable 10 and the connection module 20. The first assembly 22 having the leading end portion 10A of the cable 10 positioned therein and the second assembly 23 in an assembly attitude before assembly are shown in FIGS. 2A and 2B. FIG. 2A shows the second assembly 23 positioned above in order to show a structure for positioning the leading end portion 10A of the cable 10 in the first assembly 22. In addition, FIG. 2B shows the second assembly 23 positioned below in order to show a structure on a side coming into contact with the cable 10 of the second assembly 23.

The cable 10 is incorporated into the first assembly 22, as shown in FIG. 2A. That is, the contact 21 (see FIG. 1) is inserted into the insertion hole 221*a* of the inner housing 221. Thereupon, the exposed portion 121*a* of the covered electrical wire 12 rests on the rest portion 221*b* (see FIG. 1) of the inner housing 221. A shield contacting portion 222*a* is provided in a position corresponding to the ferrule 14, shown in FIG. 4B, in the metal shell 222 constituting the first assembly 22. The shield contacting portion 222*a* has a barrel shape, and comes into contact with the portion 13B of the shield layer 13 that is folded back on the ferrule 14.

The metal shell 232 constituting the second assembly 23, as shown in FIG. 2B, has the presser portion 232*a* and a shield contacting portion 232*b*. The presser portion 232*a*, as described before, presses the exposed portion 121*a* of the covered electrical wire 12 resting on the rest portion 221*b* of the first assembly 22 against the rest portion 221*b* to locate and fix the exposed portion 121*a*. In addition, the shield contacting portion 232*b*, like the shield contacting portion 222*a* of the first assembly 22, has a barrel shape, and comes into contact with the portion 13B folded back on the ferrule 14 of the shield layer 13. The connection module 20 performs fixation and impedance matching of the exposed portion 121*a* by this work. Therefore, both good assemblability and high-accuracy impedance matching are achieved.

Figure 3A:
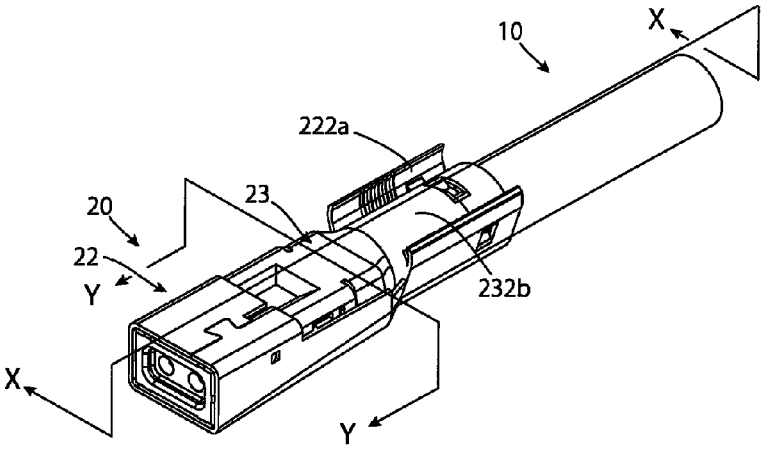
FIG. 3A is a perspective view of the connection module with a second assembly assembled to a first assembly.
Figure 3B:
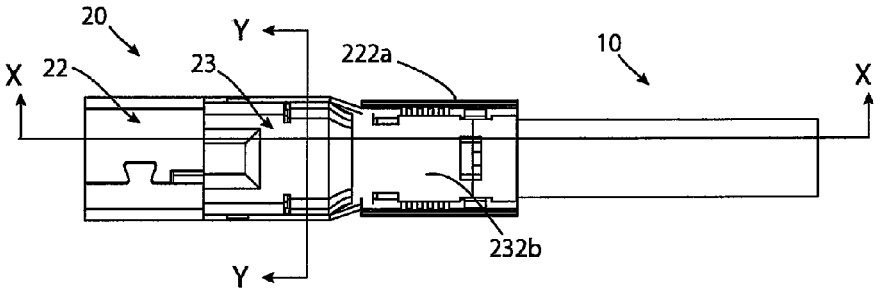
FIG. 3B is a top view of the connection module with the second assembly assembled to the first assembly.

As shown in FIGS. 2A and 2B, after the leading end portion 10A of the cable 10 is positioned in the first assembly 22, the second assembly 23 is positioned on the first assembly 22, as shown in FIGS. 3A and 3B. Then, further, the shield contacting portion 222*a* of the metal shell 22 of the first assembly 22 is fixed by swaging onto the shield contacting portion 232*b* of the metal shell 232 of the second assembly 23. By this fixation by swaging, assembly of the connection module 20 is completed. Further, thereafter, the connection module 20 is accommodated in the outer housing main body 31 and so fixed as to be retained by the retainer 32. Thereby, the cable assembly 1A as the first embodiment of the present invention is completed.

The longitudinal sectional view taken along arrows X-X shown in FIG. 4A shows the contact 21 inserted in the insertion hole 221*a* formed in the inner housing 221 of the first assembly 22. In addition, the exposed portion 121*a* of the covered electrical wire 12 rests on the rest portion 221*b* of the inner housing 221 of the first assembly 22. Furthermore, the presser portion 232*a* of the metal shell 232 of the second assembly 23 presses the exposed portion 121*a* resting on the rest portion 221*b* against the rest portion 221*b*. The inner housing 231 of the second assembly 23 is positioned on a front side in relation to the presser portion 232*a*, and a space 232*c* is formed on a back face side opposite to a presser face 231*d* facing toward the exposed portion 121*a* of the presser portion 232*a*.

Figure 4B:
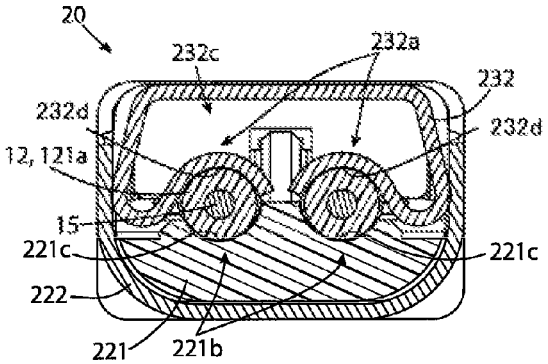
FIG. 4B is a sectional end view of the connection module after assembly completion, taken along arrows Y-Y of FIGS. 3A and 3B.

With reference to FIG. 4B, the structure of a portion where the exposed portion 121*a* of the covered electrical wire 12 is positioned will be further described.

As described above, the rest portion 221*b* is provided in the inner housing 221 of the first assembly 22. Furthermore, a rest face 221*c* of the rest portion 221*b* that comes into contact with the exposed portion 121*a* is so shaped as to have a recessed groove having a shape along the contour of the exposed portion 121*a*. Because the recessed groove is formed in the rest portion 221*b*, each of the two covered electrical wires 12 is arranged in a corresponding predetermined position, and a space between these two covered electrical wires 12 is also a predetermined space. This point also contributes to impedance stabilization.

On the other hand, the presser portion 232*a* is formed in the metal shell 232 of the second assembly 23. The presser face 232*d* of this presser portion 232*a* that comes into contact with the exposed portion 121*a* of the covered electrical wire 12 has an arcuate shape that is a shape along the contour of the exposed portion 121*a*, and comes into direct contact with the exposed portion 121*a*, covering an upper side of the exposed portion 121*a* substantially semi-circumferentially, as shown in FIG. 4B. Thus, high-accuracy impedance matching is enabled. On the back face side of this presser portion 232*a* opposite to the presser face 232*d* the inner housing 231 does not exist, but the space 232*c* exists.

The presser portion 232*a* is located in a position a little lower than a position shown in FIGS. 4A and 4B when the presser portion 232*a* is separated from the exposed portion 121*a* of the covered electrical wire 12. Then, when the second assembly 23 is rested on the first assembly 22, the presser portion 232*a* comes into contact with the exposed portion 121*a*, and elastically deforms toward narrowing the space 232*c* to press the exposed portion 121*a* against the rest portion 221*b*. Then, the shield contacting portion 222*a* of the metal shell 222 of the first assembly 22 is fixed by swaging onto the shield contacting portion 232*b* of the metal shell 232 of the second assembly 23. Thereupon, the presser portion 232*a* elastically deforms to keep pressing the exposed portion 121*a*. In this manner, a portion of the metal shell 232 constitutes the presser portion 232*a*, and this presser portion 232*a* presses the exposed portion 121*a*. Thereby, the exposed portion 121*a* is located, and further retained, and simultaneously the impedance of the exposed portion 121*a* lowers to make an impedance match with a portion covered with the jacket 11 of the covered electrical wire 12. This presser portion 232*a* has springiness, and therefore, even if there is a part tolerance, the exposed portion 121*a* is reliably pressed against the rest portion 221*b* by the presser portion 232*a* in an elastically deformed state, and thereby the exposed portion 121*a* is reliably retained in a predetermined position.

In the present embodiment, both the metal shell 222 of the first assembly 22 and the metal shell 232 of the second assembly 23 have the shield contacting portions 222*a*, 232*b* that come into contact with the shield layer 13 of the cable 10. Then, the shield contacting portion 222*a* of the first assembly 22 is fixed by swaging onto the shield contacting portion 232*b* of the second assembly 23. Thereby, the first assembly 22 and the second assembly 23 are integrated together with the metal shells 222, 232 in contact with each other. These metal shells 222, 232 are in contact with the shield layer 13 of the cable 10 and retained at the same electric potential as the shield layer 13. In addition, the inside of the connection module 20 is shielded by combining these metal shells 222, 232. However, it is only necessary that the inside of the connection module 20 be shielded by combining these metal shells 222, 232. That is, the structure does not need to be a structure in which both the metal shells 222, 232 come into contact with the shield layer 13, but may also be a structure in which either one of the metal shells 222, 232 comes into contact with the shield layer 13, and both the metal shells 222, 232 come into contact with each other. In an embodiment, the second metal shell 232 achieves both the function of pressing the exposed portion 121*a* and the shielding function of the connection module 20 in cooperation with the first metal shell direct It should be noted that the description here has been made taking as an example the cable 10 having the shield layer 13. However, the structure in which the exposed portion 121*a* where the covered electrical wire 12 is exposed is rested on the rest portion 221*b* and pressed by the conductive presser portion 232*a* is not relevant to whether or not the cable 10 has the shield layer 13. That is, the present invention is applicable to a cable not having a shield layer. By applying the present invention, regardless of whether or not the cable 10 has the shield layer 13, the impedance at the leading end portion of the covered electrical wire 12 can be matched with the impedance of portions of the covered electrical wires 12 that are twisted around each other to form a twisted pair.

In addition, the presser portion 232*a* here is constituted as a portion of the metal shell 232. Therefore, the presser portion 232*a* is made of a metal material. However, though it is preferred that the presser portion 232*a* have a high conductivity, the presser portion 232*a* does not necessarily need to be made of a metal material. That is, as long as the presser portion 232*a* is made of a material having a higher conductivity than air, the impedance of the exposed portion 221*b* of the covered electrical wire 12 can be made close to the impedance of the portions of the covered electrical wires 12 that are twisted around each other to form a twisted pair.

In addition, here, the contact 21 is connected by crimping to the core wire 15, but, instead of crimping connection, they are connected together by another connection, for example, a soldering connection, or the like.

Figure 5:
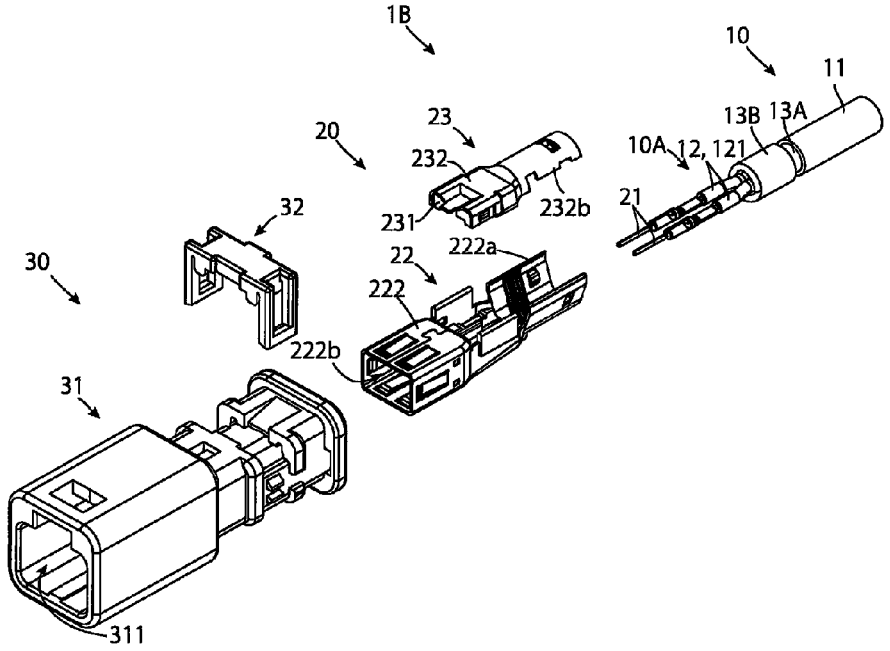
FIG. 5 is an exploded perspective view of a cable assembly according to another embodiment.

FIG. 5 is an exploded isometric view of a cable assembly 1B as a second embodiment of the present invention. Here, a component corresponding to a component of the cable assembly 1A of the first embodiment shown in FIG. 1 is denoted by the same reference sign as a reference sign used in FIG. 1 even if they differ in shape or the like, and their functional difference will be described.

A cable 10 of a cable assembly 1B of this second embodiment is a cable having the same structure as the cable 10 of the first embodiment. However, a male contact 21 is connected by crimping to the front end portion 151 of the core wire 15.

In addition, a fitting-in space 222*b* into which a front end portion 20*a* of the connection module 20 shown in FIG. 1 is formed in the first assembly 22 of the connection module 20 constituting the cable assembly 1B of the second embodiment. Though this first assembly 22 is also provided with the inner housing 221, the inner housing 221 is positioned on a rear side in relation to this fitting-in space 222*b*, and invisible in FIG. 5. However, in the case of the second embodiment, similarly, the rest portion 221*b* (invisible in FIG. 5) similar to one in the first embodiment is provided in this inner housing 221.

The second assembly 23 of this second embodiment is a component having the same structure and the same shape as the second assembly 23 of the first embodiment.

A mating space 311 that a front end portion 30*a* of the outer housing 30 of the first embodiment enters is formed in the outer housing main body 31 of the outer housing 30 of this second embodiment 1B. The retainer 32 of this second embodiment 1B is different in shape from the retainer 32 of the first embodiment, but has the same function.

The cable assembly 1B of this second embodiment is assembled in the same manner as the cable assembly 1A of the first embodiment. Then, the front end portion 30*a* of the outer housing 30 of the first embodiment is fitted into the mating space 311 of the outer housing 30 of this second embodiment. Thereupon, the front end portion 20*a* of the connection module 20 of the first embodiment is inserted into the fitting-in space 222*b* of the connection module 20 of the second embodiment. Then, further, the male contact 21 of the second embodiment is inserted into the female contact 21 of the first embodiment. In this manner, the cable assembly 1A of the first embodiment and the cable assembly 1B of the second embodiment are connected together. In this manner, the present invention is applicable regardless of the shape of the contact 21 or regardless of the shape of the outer housing 30.

Figure 6A:
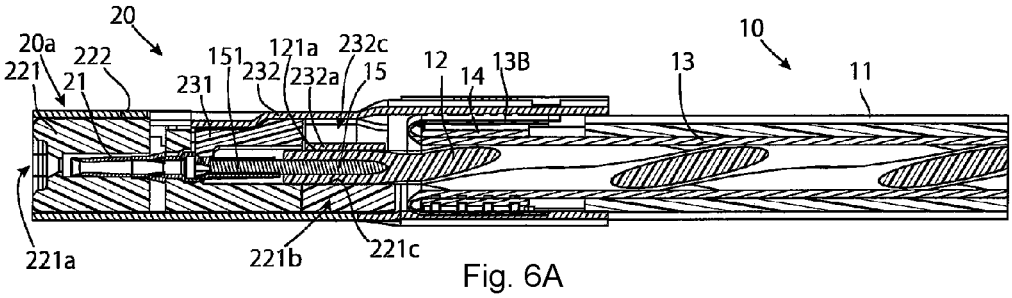
FIG. 6A is a sectional side view of a connection module of the cable assembly of FIG. 5.
Figure 6B:
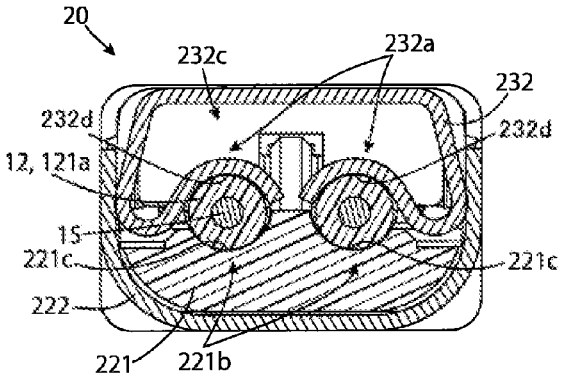
FIG. 6B is a sectional end view of the connection module of the cable assembly of FIG. 5.

FIGS. 6A and 6B are a longitudinal sectional view and a cross sectional view, respectively, of another example of a connection module 20 equivalent to FIGS. 4A and 4B of the connection module shown in FIGS. 1 to 4B. The same reference signs as those used in FIGS. 4A and 4B are used here, and only their differences will be described.

In the case of the connection module 20 shown in FIGS. 1 to 4B, as shown in FIGS. 4A and 4B, the rest portion 221*b* is formed as a portion of the inner housing 221. In addition to the rest portion 221*b*, the insertion hole 221*a* into which the contact 21 is inserted is formed in this inner housing 221. That is, the inner housing 221 having the rest portion 221*b* formed therein is a member taking not only a role as the rest portion 221*b* but also a role to retain the contact 21 inserted into the insertion hole 221*a*, or the like.

On the other hand, in the case of another example of the connection module 20 shown in FIGS. 6A and 6B, the rest portion 221*b* is a component separate from the inner housing 221. That is, this rest portion 221*b* is incorporated separately from the inner housing 221 when the connection module 20 is assembled. In this manner, the rest portion 221*b* may be a single independent component.

The connection module 20 and the cable assembly 1A and 1B according to the various embodiments achieve both good assemblability and high-accuracy impedance matching.

What is claimed is:

1. A connection module, comprising:

a first assembly having a rest portion for resting thereon an exposed portion of a covered electrical wire for differential signal transmission, a cable accommodating the covered electrical wire in a jacket, the exposed portion being not covered with the jacket and exposing a covering of the covered electrical wire; and a second assembly having a presser portion pressing the exposed portion rested on the rest portion against the rest portion, a position of the exposed portion is determined by combining the first assembly with the second assembly, a presser face of the presser portion coming into contact with the exposed portion has an arcuate shape extending along a contour of the exposed portion.

2. The connection module according to claim 1, wherein the exposed portion is retained by combining the first assembly with the second assembly.

3. The connection module according to claim 1, wherein the presser portion is formed of a material having a higher conductivity than air.

4. The connection module according to claim 1, wherein the presser portion is formed of a metal material.

5. The connection module according to claim 1, wherein the presser face of the presser portion covers at least a portion of the exposed portion.

6. The connection module according to claim 1, wherein the presser portion has a springiness for pressing, in an elastically deformed state, the exposed portion rested on the rest portion against the rest portion.

7. The connection module according to claim 1, wherein the rest portion is formed integrally with a member constituting the first assembly and acts not only for resting but also for another action.

8. The connection module according to claim 1, wherein a rest face of the rest portion coming into contact with the exposed portion has a shape extending along a contour of the exposed portion.

9. The connection module according to claim 1, wherein the cable is a shielded cable having in the jacket a shield layer for shielding the covered electrical wire.

10. The connection module according to claim 9, wherein the first assembly has a first metal shell and the second assembly has a second metal shell including the presser portion.

11. The connection module according to claim 10, wherein at least one of the first assembly and the second assembly has a shield contacting portion for coming into contact with the shield layer.

12. The connection module according to claim 11, wherein the first metal shell and the second metal shell come into contact with each other.

13. The connection module of claim 1, wherein the first assembly has a first inner housing formed of an insulative material, the rest portion is formed on a portion of the first inner housing.

14. The connection module of claim 13, wherein the first assembly has a first metal shell enclosing the first inner housing.

15. The connection module of claim 14, wherein the second assembly has a second inner housing formed of the insulative material and a second metal shell enclosing the second inner housing, the presser portion is formed on the second metal shell.

16. The connection module of claim 15, wherein the first metal shell contacts the second metal shell.

17. The connection module of claim 5, wherein the presser face semi-circumferentially covers the portion of the exposed portion.

18. A cable assembly, comprising:

a cable accommodating a covered electrical wire for differential signal transmission in a jacket and having an exposed portion of the covered electrical wire formed therein, the exposed portion being not covered with the jacket and exposing a covering of the covered electrical wire; and a connection module including a first assembly and a second assembly, the first assembly having a rest portion for resting thereon the exposed portion of the covered electrical wire, the second assembly having a presser portion pressing the exposed portion rested on the rest portion against the rest portion, a position of the exposed portion is determined by combining the first assembly with the second assembly, a presser face of the presser portion coming into contact with the exposed portion has an arcuate shape extending along a contour of the exposed portion.

19. The cable assembly according to claim 18, wherein the presser portion comes into direct contact with the exposed portion.

20. The cable assembly according to claim 18, further comprising an outer housing accommodating the connection module.

* * * * *